US005269385A

United States Patent [19]

Sihlis

[11] Patent Number: 5,269,385

[45] Date of Patent: Dec. 14, 1993

[54] ADJUSTABLE BENT HOUSING II

[75] Inventor: Lennard Sihlis, Calgary, Canada

[73] Assignee: Canadian Fracmaster Ltd., Canada

[21] Appl. No.: 34,599

[22] Filed: Mar. 15, 1993

Related U.S. Application Data

[63] Continuation of Ser. No. 875,047, Apr. 28, 1992.

[30] Foreign Application Priority Data

Mar. 16, 1992 [CA] Canada ..... 2063161

[51] Int. Cl.[5] ..... E21B 7/08

[52] U.S. Cl. ..... 175/74; 175/322

[58] Field of Search ..... 175/73-76, 175/320-326

[56] References Cited

U.S. PATENT DOCUMENTS 4,220,214 9/1980 Benoit .
4,303,135 12/1981 Benoit .
4,522,272 6/1985 Beimgraben .
4,596,294 6/1986 Russell .
4,641,717 2/1987 Eppink .
4,745,982 5/1988 Wenzel .
4,813,497 3/1989 Wenzel .
4,884,643 12/1989 Wawrzynowski et al. .... 175/322 X
5,029,654 7/1991 Wilson et al. .
5,048,621 9/1991 Bailey et al. .
5,052,501 10/1991 Wenzel et al. .
5,101,914 4/1992 Wenzel ..... 175/74
5,101,915 4/1992 Witte ..... 175/74
5,117,927 6/1992 Askew ..... 175/74 X

*Primary Examiner*—Thuy M. Bui
*Attorney, Agent, or Firm*—Lerner, David, Littenberg, Krumholz & Mentlik

[57] ABSTRACT

There is described an adjustable bent housing comprising a cylindrical housing having an uphole and a downhole end and a bore formed therethrough, the bore being divided into uphole and downhole portions axially offset to one another, and a tubular mandrel having an uphole and a downhole end, the ends being axially offset to one another. The downhole end of the mandrel is receivable along a portion of its length into the uphole portion of the bore in the housing for rotational movement relative to the cylindrical housing for varying the angle of bend between the mandrel and the cylindrical housing. Also provided is a locking mechanism comprising outer and inner concentric sleeves disposed annularly about the mandrel. The inner sleeve is axially movable relative to the mandrel in response to rotation of the outer sleeve between a first locked position wherein splines provided at one end of the inner sleeve are moved into contact with cooperating splines provided on the cylindrical housing and mandrel to prevent relative rotation therebetween, and a second unlocked position in which the splines disengage the cooperating splines on at least either the mandrel or the cylindrical housing to permit relative rotation therebetween.

14 Claims, 3 Drawing Sheets

ADJUSTABLE BENT HOUSING II

This is a continuation of application Ser. No. 07/875,047 filed Apr. 28, 1992.

FIELD OF THE INVENTION

The present invention relates to downhole drilling tools and more particularly to an adjustable bent housing or sub useful in the directional drilling of well bores.

BACKGROUND OF THE INVENTION

"Bent housings" or "subs" are commonly used in well drilling in order to deviate the borehole from vertical to a desired angle. "Housings" are short threaded sections of drill pipe. They are "bent" either by physical bending or machined to create an angular offset between the respective ends of the housing. When the bent housing is placed in the drill string, the bend in the housing causes the drill string to deviate from vertical as drilling progresses. One drawback in the use of bent housings is that the angle is fixed. This means that numerous bent housings must be kept at the drill site to provide a selection of a range of angles which may be required as drilling progresses. The trend in the industry has, therefore, been to develop a single bent housing on which the angle can be adjusted. The angle of the present housing is adjusted prior to insertion into the well, and remains fixed until withdrawn and readjusted. Housings of this type are therefore referred to as "surface adjustable" bent housings, to distinguish them from housings that are "downhole adjustable", that is, adjustable while in the well bore without being withdrawn to the surface.

Although the terms "subs" and "housings" are sometimes used synonymously, a "sub" is typically a bent section installed in the drill string above the downhole motor/bearing assembly/drill bit combination used in the directional drilling of well bores. A "housing" on the other hand fits between the motor and the bearing assembly and in addition to providing bend, it also accommodates a drive shaft connecting the motor to the bearing assembly/drill bit through its central bore. The present invention is intended for use primarily as an adjustable bent "housing".

SUMMARY OF THE INVENTION

The present invention represents an alternate structure for an adjustable bent housing.

It is an object of the present invention to provide an adjustable bent housing obviating and mitigating from the disadvantages of the prior art.

According to the present invention, there is provided an adjustable bent housing, comprising a cylindrical housing having a first uphole and a second downhole end and a bore formed therethrough, the bore being divided into uphole and downhole portions, the portions being axially offset to one another, a tubular mandrel having a first uphole end and a second downhole end, the ends being axially offset to one another, the downhole end of the mandrel being receivable along a portion of its length into the uphole portion of the bore for rotational movement relative to the cylindrical housing for varying the angle of bend between the mandrel and the cylindrical housing, and locking means comprising a first outer and a second inner concentric sleeve disposed annularly about the mandrel, the inner sleeve being axially movable relative to the mandrel in response to rotation of the outer sleeve between a first locked position wherein engagement means provided at one end of the inner sleeve are moved into contact with cooperating engagement means provided on the cylindrical housing and mandrel to prevent relative rotation therebetween, and a second unlocked position in which the engagement means disengage the cooperating engagement means on at least one of the mandrel or cylindrical housing to permit relative rotation therebetween.

According to a further aspect of the present invention, there is also provided an adjustable bent housing comprising a tubular mandrel having an uphole and a downhole end with radially outwardly extending splines formed adjacent the downhole end, the tubular mandrel having a bend of a predetermined angle formed therein, a cylindrical housing having a bore formed therethrough between a downhole and an uphole end of the cylindrical housing, the uphole end of the bore having radially inwardly extending splines formed thereon, the bore having a bend of a predetermined angle formed therein, the downhole end of the tubular mandrel being concentrically receivable within the uphole end of the cylindrical housing to be rotatable relative thereto to vary the angle of the bent housing in response to the rotation, and locking means disposed annularly around the downhole end of the tubular mandrel between the uphole ends of the cylindrical housing and mandrel, the locking means including a first inner sleeve axially movable between a first locked and a second unlocked position in response to rotation of a cooperatively associated outer sleeve, the inner sleeve including a spline section thereon to engage the splines on the cylindrical housing and the mandrel when in the locked position to prevent relative rotation between the cylindrical housing and mandrel, and to disengage the splines on at least the cylindrical housing when in the unlocked position to permit the relative rotation between the cylindrical housing and mandrel.

BRIEF DESCRIPTION OF THE DRAWINGS

Preferred embodiments of the present invention will now be described in greater detail, and will be better understood when read in conjunction with the following drawings, in which.

DETAILED DESCRIPTION OF THE PREFERRED EMBODIMENTS

Figure 1:
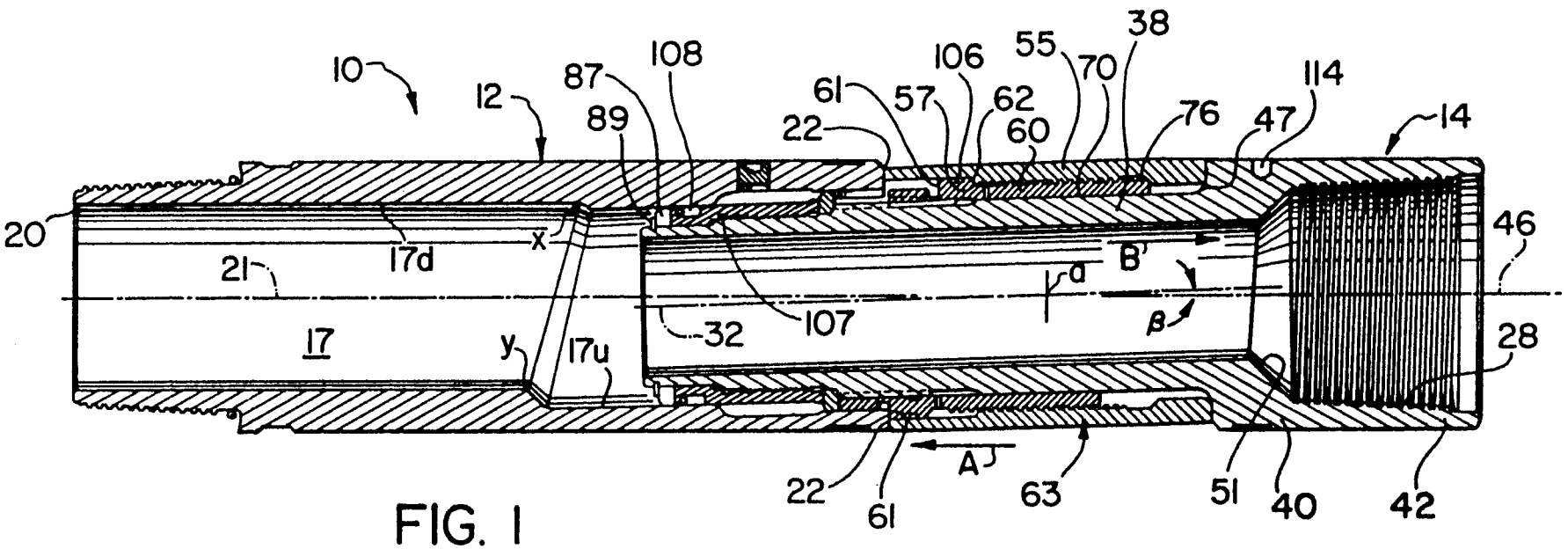
FIG. 1 is a partially cross-sectional elevational view of the bent housing described herein.
Figure 2:
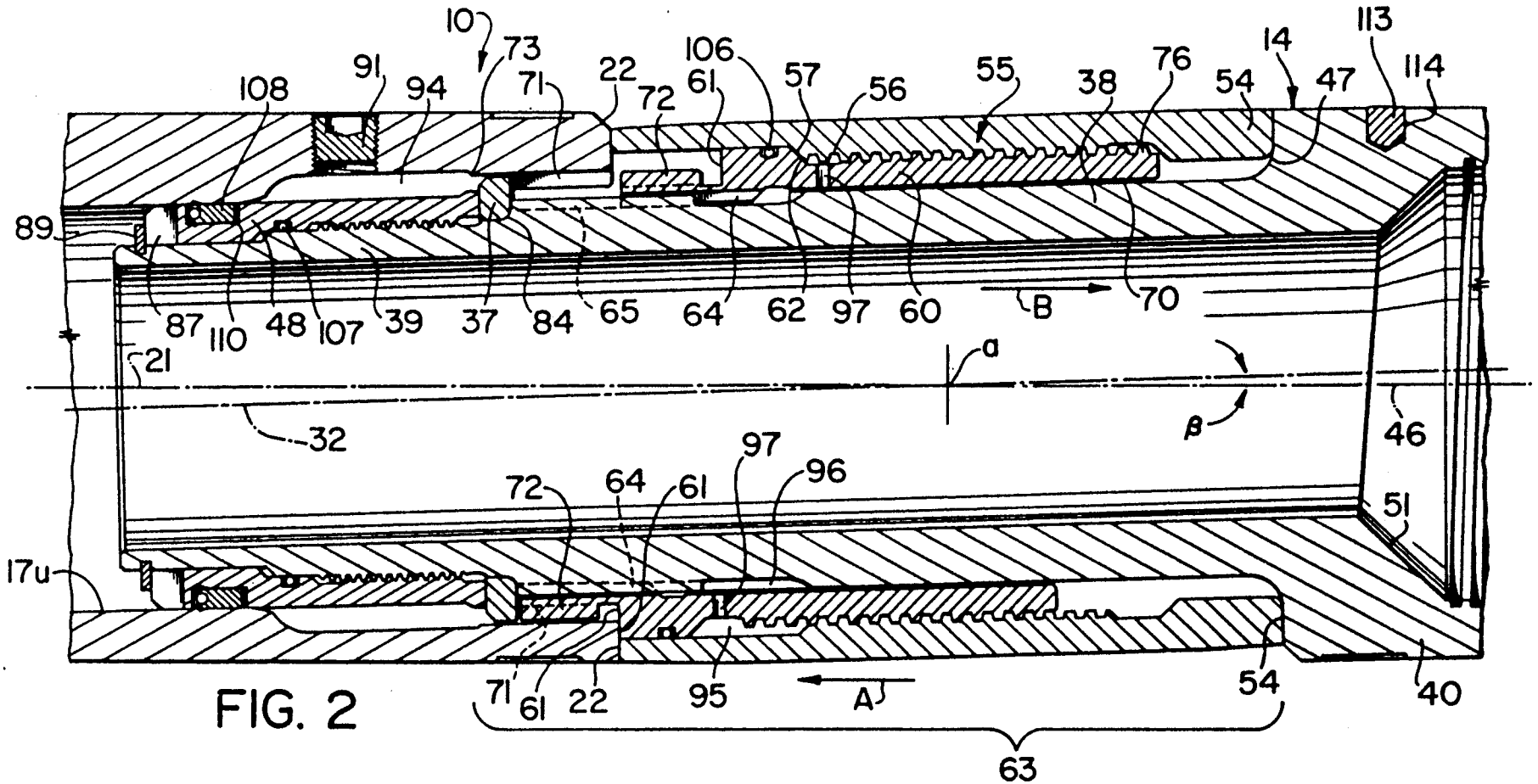
FIG. 2 is an enlarged elevational view of a part of the bent housing of FIG. 1 representing the locking means.

With reference to FIGS. 1 and 2, adjustable bent housing 10 for use in directional well drilling generally comprises a tubular offset housing 12 and a tubular offset mandrel 14 located in the uphole direction from housing 12.

Generally speaking, it is desirable that bent housing 10 be adjustable to provide 2 to 3° of total bend relative to the longitudinal axis 21 of housing 12. When viewed externally, housing 12 is symmetrical about its longitudinal axis 21, which axis will deviate up to a maximum of 3° (in the embodiment shown herein) relative to the longitudinal axis of the drill string or downhole motor (not shown) connected to mandrel 14 by means of threaded connection 28.

One-half, equal to 1½°, of the bent housing's total adjustable offset is provided by the angled portion of bore 17 of housing 12. Bore 17 includes a non-angled downhole portion 17*d* extending from downhole end 20 of housing 12 to the intermediate points marked x and y in FIG. 1 which is axially aligned and centered within the housing. Uphole of x and y, extending to the uphole end 22 of the housing, an uphole portion 17*u* of bore 17 is formed at an angle of 1½° relative to downhole bore 17*d* and to the longitudinal axis of housing 12.

The remaining one-half of the housing's total bend, which in the case of the embodiment shown in the drawings is again 1½°, is provided by mandrel 14. Mandrel 14 comprises a cylindrical tubular barrel 40 and a tubular stinger 38. The mandrel as a whole is preferably machined as a single piece, with barrel 40 including at its end 42 a female threaded connection 28 used to connect the housing to the end of a downhole motor of the sort used for the directional drilling of oil wells.

Barrel 40 is symmetrical about the mandrel's longitudinal axis, but stinger 38 is machined at an angle of 1½° relative to the barrel, the offset being measured from bend point "a". The offset is identified in FIG. 1 as angle $\beta$. Stinger 38 is otherwise symmetrical about its longitudinal axis 32 except internally at 51 where its inner diameter widens out into the inner diameter of barrel 40.

As shown in FIG. 1, stinger 38 is telescopically received into bore 17*u* of housing 12 so that its longitudinal axis is parallel and coaxial with the longitudinal axis of bore 17*u*. As illustrated in FIG. 1, the mandrel is inserted so that its 1½° deflection is exactly offset by the 1½° deflection of bore 17*u*. The longitudinal axis 46 of barrel 40 and the longitudinal axis 21 of housing 12 are therefore aligned so that housing 10 as a whole is perfectly straight.

It will be appreciated that if the housing's total adjustable bend is not divided equally between the mandrel on the one hand and the housing on the other hand, a complete offset of the two angles will not be possible, with the result that the housing will always possess a predetermined amount of bend depending upon the apportionment of the offset between the mandrel and the housing.

If the mandrel and housing are rotated relative to each other by 180°, the two offsets described above will complement each other to provide a total cumulative bend in the housing of 3° measured from point "a". More specifically, longitudinal axes 46 and 21 will intersect each other at point "a" at an angle of 3°. A further 180° relative rotation of the mandrel and housing will again bring the total bend in the housing to 0° to thereby straighten the tool.

It is desirable that the amount of bend in the housing be incrementally adjustable, and that means be provided to lock the housing at a predetermined bent angle and to prevent accidental or unintentional changes to the housing's bend when in use downhole.

This requires that means be provided to non-rotatably connect mandrel 14 to housing 12 when the housing is in use to prevent relative rotation therebetween. These means must however be releasable to permit such rotation when it is desired to change or adjust the housing's bend.

Figure 3:
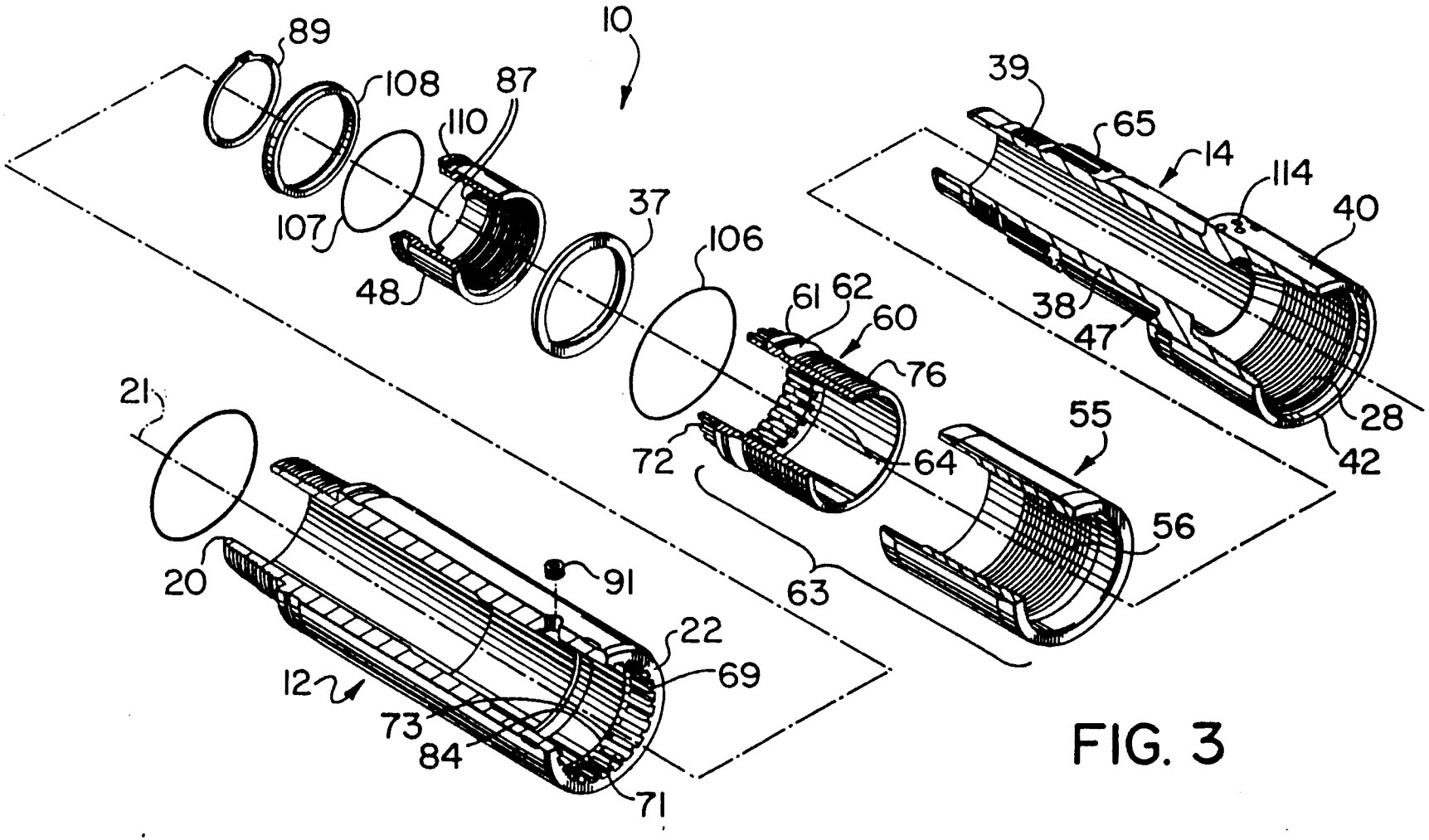
FIG. 3 is an exploded, perspective view of the bent housing of FIG. 1.

With reference particularly to FIG. 2, locking means 63 comprise a plurality of circumferentially spaced apart elongated splines 65 formed on the outer surface of stinger 38, a plurality of circumferentially spaced apart elongated splines 71 formed on the inner surface of housing 12 at the uphole end 22 thereof, a spline sleeve 60 and a locking sleeve 55. Spline sleeve 60 includes a set of circumferentially spaced apart elongated splines 64 formed on its inner surface to engage splines 65 on the mandrel and another set of circumferentially spaced apart elongated splines 72 formed on its outer surface to engage splines 71 on the housing as will be described in greater detail below. All of the housing's splines are elongated in the longitudinal direction of stinger 38, and extend either radially inwardly or outwardly from the surfaces on which they are formed, as the case may be. Splines 71 are chamfered at their uphole ends 69 as seen most clearly from FIG. 3. This facilitates the meshing of splines 71 and 72.

Splines 64 and 65 fit slidably closely in an interfingering relationship, as do splines 71 and 72 when the housing is locked.

In FIGS. 1 and 2, housing 10 is shown for comparative purposes in both its locked and unlocked (adjusting) position. Above the centre line (axis 21), the housing is shown with locking means 63 in the unlocked position thereof permitting relative rotation between the housing and mandrel for adjustment to the tool's bend. Below the centre line, the tool is shown in the locked position in which the housing and mandrel can no longer rotate relative to each other. As will now be described in greater detail, spline sleeve 60 can be moved between its locked and unlocked positions by rotating locking sleeve 55 in a counterclockwise or clockwise direction.

Spline sleeve 60 includes a smooth internal bore 70 to facilitate reciprocating sliding movement along stinger 38, an externally threaded portion 76 and an enlarged flange bounded by shoulders 61 and 62. Cooperating locking sleeve 55 is internally threaded at 56 to engage threads 76 on the spline sleeve and similarly includes a shoulder 57 to abut against shoulder 62 when the housing is unlocked. In addition, locking sleeve 55 is dimensioned to be retained between the uphole end 22 of housing 12 and shoulder 47 on mandrel barrel 40.

With reference to the lower half of FIG. 2 beneath the centre line, housing 10 is locked by rotating locking sleeve 55 in the counterclockwise direction to move spline sleeve 60 in the downhole direction as indicated by arrow A. The rotation of the locking sleeve continues until shoulder 61 of the spline sleeve abuts against uphole end 22 of housing 12. In this position, splines 71 and 72, and 64 and 65, respectively, are fully engaged to prevent relative rotation between the mandrel and the housing. Sleeve 55 is then torqued tight to prevent the spline sleeve from loosening and to hold the entire housing as a rigid unit. When the housing is thusly locked, uphole end 54 of sleeve 55 compressively abuts against shoulder 47 of the mandrel to form a metal-to-metal seal.

To adjust the bend of the housing, the locking sleeve is rotated clockwise to move spline sleeve 60 in the uphole direction indicated by arrow B in the upper half of FIG. 2 above the centre line. The rotation of the locking sleeve continues until shoulders 62 and 57 abut to prevent further rotation, thereby indicating that splines 71 and 72 are now fully disengaged. Mandrel 14 is now freely rotatable relative to housing 12 to adjust the angle of the housing's bend. Splines 65 are sufficiently elongated to remain meshed with splines 64 even with the locking sleeve in this position so that the locking sleeve is rotated with the mandrel. If there are 24 of each of splines 71 and 72, the possible settings for the housing's bend are, incrementally, 0°, 0.391°, 0.776°, 1.147°, 1.500°, 1.826°, 2.121°, 2.379°, 2.598°, 2.7711°, 2.897°, 2.974°, 3.000° and further identical increments back to 0°. After the desired amount of bend has been selected, the housing is then locked into its new setting in the manner described above. Calibrations (not shown) are provided on the outer surfaces of the mandrel and housing to provide an externally readable indication of the amount of bend dialed into the tool before the locking sleeve is rotated to reengage splines 71 and 72 to set the tool at the new bend.

Housing 12 is held to mandrel 14 by means of a mandrel nut 48 and a retaining ring 37. Stinger 38 is threaded at its downhole end 39 to engage the correspondingly internally threaded mandrel nut 48. Nut 48 is torqued tight to compress retaining ring 37 between nut 48 on the one hand, and the downhole ends of splines 71 and 72 and a shoulder 84 in the stinger just below splines 71 to secure the mandrel and housing together and to prevent longitudinal movement between these two components.

To assemble the housing, mandrel nut 48 is first inserted into bore **17*u* as far as it will go. Retaining ring 37 is then inserted into the housing by sliding it sideways through the gaps between splines 71 and is then rotated 90° to seat against the downhole ends of splines 71. The mandrel nut is then moved in an uphole direction to seat against ring 37. The mandrel is inserted and the mandrel nut is then torqued tightly onto the mandrel using a wrench (not shown) inserted through the downhole end 20 of housing 12 to engage notches 87 provided for this purpose in the rearward end of the nut. Once the nut is torqued onto the mandrel, a snap ring 89** may be installed to positively prevent any loosening of the mandrel nut.

A grease plug 91 is provided in the housing to add grease for lubrication of the housing's internal splines and threaded mechanisms and to prevent drilling mud from entering these parts of the tool. Splines 71 each include a shallow rearward extension 73 which spaces ring 37 from the inner surface of bore **17*u*, and the gaps between these shallow extensions allows the grease to migrate from cavity 94 surrounding the mandrel nut into the spline mechanisms and into cavities 95 and 96 between stinger 38, spline sleeve 60 and locking sleeve 55. Passageways 97 and other passages (not shown) allow the grease to reach these cavities and other places internally of the housing where its needed. When locking collar 55** is torqued to lock the housing, the grease is sealed inside the tool to prevent or at least to minimize the ingress of drilling mud into the splines and threads.

As will be appreciated by those skilled in the art, drilling mud will be pumped under considerable pressure through the interior of housing 10, including the housing and mandrel, to the drill bit (not shown). The mud will return to the surface through the annulus between the drill string, and the inner surface of the well bore. It is important that mud not escape through any of the housing's joints as this will cause a loss of circulation at the bit, in which event the entire string must be removed for repairs to the housing, causing considerable delay and expense. Similarly, it is desirable to prevent mud from the annulus from getting into the housings internal threads and splines. The present housing uses various seals to prevent the escape or incursion of mud.

Commencing at the uphole end of the housing, a metal-to-metal seal is formed between end 54 of locking sleeve 55 and the abutting portion of mandrel shoulder 47 when the housing is locked to prevent the entry of mud at this point. When sleeve 55 is torqued to lock the housing, there will be a slight gap or at least a loose fit between the downhole end of this sleeve and the end 22 of housing 12 through which mud can enter. Sealing between sleeves 55 and 60 between shoulders 61 and 62 to prevent mud from entering cavity 95 and threads 56 and 76 is provided by an O-ring 106. The metal-to-metal seal between shoulder 61 and end 22 of housing 12 seals against mud entering splines 71, 72 and cavity 94. Sealing between mandrel nut 48 and stinger 38 just downhole of the threaded connection between the nut and stinger is provided by another O-ring 107. A polypak seal 108 provided in a circumferential groove 110 formed in nut 48 seals the interface between nut 48 and angled housing bore **17*u***.

To protect the outer surface of housing 10 from excessive wear, tungsten carbide buttons 113 may be press-fitted into holes 114 formed circumferentially about the outer surface of mandrel 14 as shown, and a shallow tungsten carbide hard facing may be applied in bands about the outer surface of housing 12.

Adjustments to the housing's bend are usually made at the surface. Housing 12 may be clamped in the derrick's rotary table and the locking sleeve can then be operated using the rig's power tongs. The rotary table can then be used to rotate mandrel 14 in order to dial in the required bend as read from the calibrations provided on the housing's outer surface. The tongs are then used to tighten the locking sleeve to re-engage the splines 71 and 72 and lock the housing for use downhole.

Some of the advantages enjoyed by the present housing over earlier designs include the lack of any loose parts on the exterior of the housing that require removal for adjustments to the tool or that could become lost downhole. Moreover, the length of the housing remains constant and does not change when the housing is either locked or unlocked to make adjustments to its bend. The housing's overall design minimizes the number of required parts which lowers its manufacturing costs, and the tolerances between parts are less critical than is the case with a number of prior art housings, and this again facilitates manufacture at a lower cost. By varying the number and size of the splines and the offset angles of the mandrel and the angled bore of the housing, the housing can be manufactured in different versions depending upon the total amount of bend to be provided.

It will be apparent to those skilled in the art that modifications may be made to the preferred embodiment described herein without departing from the spirit and scope of the spirit and scope of the invention.

I claim:

1. An adjustable bent housing, comprising:

a cylindrical housing having a first uphole and a second downhole end and a bore formed therethrough, said bore being divided into uphole and downhole portions, said portions being axially offset to one another;

a tubular mandrel having a first uphole end and a second downhole end, said ends being axially offset to one another, the downhole end of said mandrel being receivable along a portion of its length into said uphole portion of said bore for rotational movement relative to said cylindrical housing for varying the angle of bend between said mandrel and said cylindrical housing; and locking means comprising a first outer and a second inner concentric sleeve disposed annularly about said mandrel, said inner sleeve being axially movable relative to said mandrel in response to rotation of said outer sleeve between a first locked position wherein engagement means provided at one end of said inner sleeve are moved into contact with cooperating engagement means provided on said cylindrical housing and mandrel to prevent relative rotation therebetween, and a second unlocked position in which said engagement means disengage said cooperating engagement means on at least one of said mandrel or cylindrical housing to permit relative rotation therebetween.

2. The adjustable bent housing of claim 1 wherein said engagement means comprise a first outer set of radially outwardly extending members and a second inner set of radially inwardly extending members disposed circumferentially about said one end of said inner sleeve.

3. The adjustable bent housing of claim 2 wherein said cooperating engagement means comprise a third set of radially inwardly extending members disposed circumferentially about said uphole end of said cylindrical housing and a fourth set of radially outwardly extending members disposed circumferentially about said downhole end of said mandrel, said first and third and said second and fourth sets being respectively slidable relative to each other in the longitudinal direction of said downhole end of said mandrel, such that in said first locked position, said first and third and said second and fourth sets, respectively, engage one another to prevent said relative rotation, and in said second unlocked position at least said first and third sets are disengaged from one another to permit said relative rotation.

4. The adjustable bent housing of claim 3 wherein said inwardly and outwardly extending members of said first to fourth sets comprise a plurality of parallel splines elongated in the longitudinal direction of said downhole end of said mandrel, said first and third and said second and fourth sets of splines being adapted to respectively mesh with one another when said locking means are in said locked position thereof.

5. The adjustable bent housing of claim 4 wherein said first and second concentric sleeves are threadedly connected together for axial movement of said inner sleeve in response to rotation of said outer sleeve.

6. The adjustable bent housing of claim 5 wherein said locking means are disposed between said uphole end of said cylindrical housing and the uphole end of said tubular mandrel against a shoulder portion formed between said uphole and downhole portions of said mandrel.

7. The adjustable bent housing of claim 6 wherein said inner sleeve includes a first shoulder thereon to compressively abut against said uphole end of said cylindrical housing when said locking means are in said locked position thereof to limit the travel of said inner sleeve towards said cylindrical housing and to form a seal therewith.

8. The adjustable bent housing of claim 7 wherein said inner sleeve includes a second shoulder formed thereon to compressively abut against an opposing shoulder formed on said outer sleeve when said locking means are in said unlocked position thereof to limit the travel of said inner sleeve away from said cylindrical housing and to indicate when said first and third sets of said splines are disengaged.

9. The adjustable bent housing of claim 8 wherein said mandrel is held to said cylindrical housing by tubular nut means threadedly secured to said downhole end of said mandrel and a retaining ring circumferentially disposed between said nut means and downhole ends of said first and third sets of splines.

10. The adjustable bent housing of claim 9 wherein said offset in the uphole portion of said bore equals said offset in the tubular mandrel such that said offsets cancel one another in a first radial position between said cylindrical housing and said mandrel, and are fully additive when said cylindrical housing and mandrel are rotated 180° relative to one another from said first radial position thereof.

11. The adjustable bent housing of claim 10 wherein the offset between said uphole and downhole portions of said bore is in the range from 1° to 1½°.

12. The adjustable bent housing of claim 11 wherein the offset between the uphole and downhole portion ends of said mandrel is in the range between 1° to 1½°.

13. The adjustable bent housing of claim 12 further including sealing means to prevent the passage of fluid between the interior and exterior surfaces of said adjustable bent housing.

14. An adjustable bent housing comprising:

a tubular mandrel having an uphole and a downhole end with radially outwardly extending splines formed adjacent said downhole end, said tubular mandrel having a bend of a predetermined angle formed therein;

a cylindrical housing having a bore formed therethrough between a downhole and an uphole end of said cylindrical housing, said uphole end of said bore having radially inwardly extending splines formed thereon, said bore having a bend of a predetermined angle formed therein;

said downhole end of said tubular mandrel being concentrically receivable within the uphole end of said cylindrical housing to be rotatable relative thereto to vary the angle of said bent housing in response to said rotation; and locking means disposed annularly around said downhole end of said tubular mandrel between said uphole ends of said cylindrical housing and mandrel, said locking means including a first inner sleeve axially movable between a first locked and a second unlocked position in response to rotation of a cooperatively associated outer sleeve, said inner sleeve including a spline section thereon to engage said splines on said cylindrical housing and said mandrel when in said locked position to prevent relative rotation between said cylindrical housing and mandrel, and to disengage said splines on at least said cylindrical housing when in said unlocked position to permit said relative rotation between said cylindrical housing and mandrel.

* * * * *

UNITED STATES PATENT AND TRADEMARK OFFICE

CERTIFICATE OF CORRECTION

PATENT NO. : 5,269,385

DATED : December 14, 1993

INVENTOR(S) : Lennard Sihlis

It is certified that error appears in the above-identified patent and that said Letters Patent is hereby corrected as shown below:

Column 6, line 30, fillowing "rotate" insert --the housing's housing or the tongs can be used to rotate--.

Signed and Sealed this

Thirty-first Day of May, 1994

Bruce Lehman

*Attest:*

BRUCE LEHMAN

*Attesting Officer*

*Commissioner of Patents and Trademarks*